United States Patent [19]

Okazaki et al.

[11] Patent Number: 4,712,084

[45] Date of Patent: Dec. 8, 1987

[54] POTENTIOMETER

[75] Inventors: Atsushi Okazaki, Iruma; Masahiko Igarashi, Mitaka; Tsuneo Horie, Iruma, all of Japan

[73] Assignee: Copal Electronics Co., Ltd., Tokyo, Japan

[21] Appl. No.: 841,455

[22] Filed: Mar. 19, 1986

[30] Foreign Application Priority Data

Mar. 22, 1985 [JP] Japan ..... 60-57863
Mar. 22, 1985 [JP] Japan ..... 60-57868
Mar. 22, 1985 [JP] Japan ..... 60-57864

[51] Int. Cl.[4] ..... H01C 1/02

[52] U.S. Cl. ..... 338/184; 338/163; 338/199

[58] Field of Search ..... 338/162, 163, 164, 184, 338/199

[56] References Cited

U.S. PATENT DOCUMENTS 3,111,640 11/1963 Dial ..... 338/184 X
4,427,966 1/1984 Gratzinger et al. ..... 338/162
4,465,994 8/1984 Rehberger ..... 338/184 X

*Primary Examiner*—E. A. Goldberg
*Assistant Examiner*—M. M. Lateef
*Attorney, Agent, or Firm*—Wenderoth, Lind & Ponack

[57] ABSTRACT

A potentiometer has a case, a housing, a base and a rotor rotatably arranged in the chamber of housing. The housing is provided with a pair of projections on both side walls thereof and two pair of corner projections at four corners thereof respectively while the case has a pair of bent long legs in which holes are defined to receive the side wall projections of the housing and a pair of bent short walls are arranged to cover the top of the housing. The case may be pushed down upon the housing with the pair of bent long legs thereof being slid down into vertical grooves arranged between the corner projections of the housing until the side wall projections of the housing are slidingly snapped into the holes of the case and thus, the case and the housing may be assembled in one operation. Two end walls of an arcuate portion of a narrow strip are arranged on the surface of the rotor and abut alternatively against two vertical walls of a rectangular strip arranged inside the housing hole and located adjacent a collector element of the base, whenever the rotor rotates in a clockwise or counter-clockwise direction.

4 Claims, 12 Drawing Figures

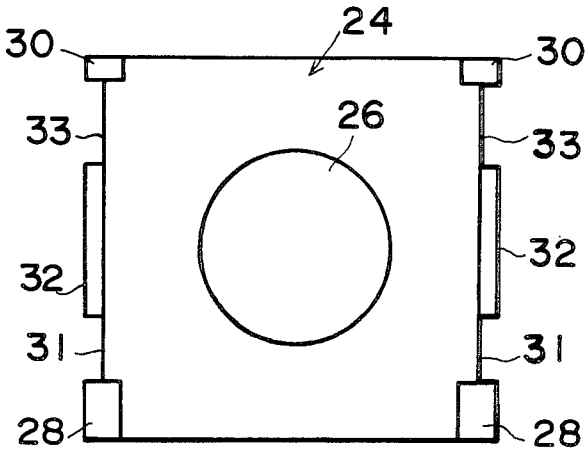
F I G. 4
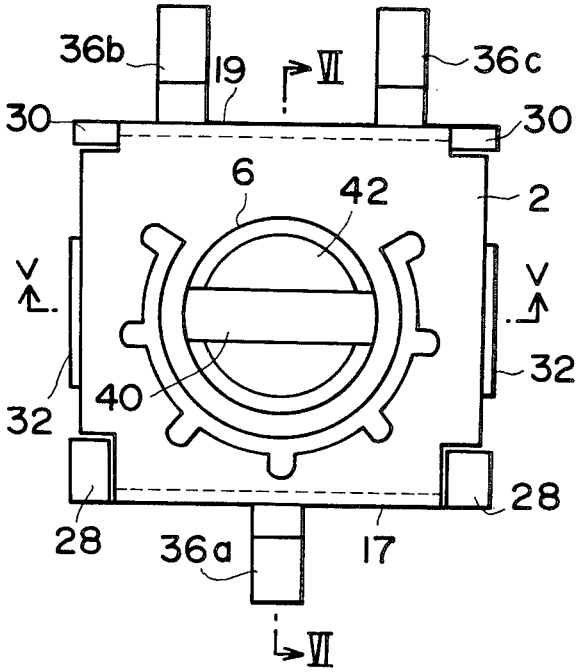

POTENTIOMETER

BACKGROUND OF THE INVENTION

This invetion relates to the field of potentiometers and more particularly to a miniaturized structure of a potentiometer.

In some of the prior art devices (U.S. Pat. No. 3,531,753, patented Sept. 29, 1970, issued to Stefan O. Geese and U.S. Pat. No. 3,601,743 patented Aug. 24, 1971, issued to Victor G. Mathison et al), a case or a cap of spun sheet metal is attached to a base of a potentiometer by depending legs or lugs which are received in complementary recessed slots formed in the base.

The legs are crimped inwardly so that the cap or a case is secured to the base to form an open-top chamber in which a rotor is held.

However, if the structure of the case of the potentiometer of the prior art is maintained it is difficult to reduce the physical size especially with respect to the thickness of the potentiometer.

Therefore this type of potentiometer may be unable to meet a demand in the market requiring miniaturized potentiometers especially having a reduced thickness.

It is an object of this invention to provide a miniaturized potentiometer having a flat and thin structure with the purpose of meeting this recent market demand.

In some prior art devices (U.S. Pat. No. 3,601,743 patented Aug. 24, 1971 and issued to Vitor G. Mathsion et al), a rotor of a potentiometer is adjusted by inserting a tool in a screw driver slot disposed in a cap thereof and by turning the rotor clockwise or counterclockwise until a top of the rotor touches a stopper disposed on the cap.

If this structure is to be maintained it is also difficult to produce thin potentiometers having a small physical size and to meet the market demand as heretofore explained.

It is another object of this invention to provide a rotor stopper device arranged within a case and a housing thereby facilitating a reduction in the physical size of a potentiometer to be obtained.

The above mentioned objects are achieved by a potentiometer of this invention which comprises: a case, a housing and a rotor which is rotatably arranged in a chamber of the housing. The housing is provided with a pair of projections on both side walls thereof and two pairs of corner projections at four corners thereof respectively while the case of the potentiometer has a pair of bent long legs in which holes are defined to receive the side wall projections of the housing and a pair of bent short walls to cover the top of the housing. The case may be pushed down onto the housing with the pair of beng long legs thereof being slid into vertical grooves arranged between the corner projections of the housing until the side wall projections of the housing are slidingly snapped into the holes of the case and thus the case and the housing may be assembled in one operation. Two end walls of a portion of a narrow strip are arranged on the surface of the rotor to alternatively abut against two vertical walls of a rectangular strip, which is arranged at the inner side of housing hole and is located adjacent to a collector element of the base, whenever the rotor rotates in a clockwise or counterclockwise direction.

BRIEF DESCRIPTION OF THE DRAWING

The present invention, however, and further objects and advantages thereof may best be understood by reference to the following description taken in connection with the accompanying drawings in which;

FIG. 3 is a plan view of a housing without a rotor and a base;

FIG. 4 is a plan view of a potentiometer of this invention;

DETAILED DESCRIPTION OF THE PREFERRED EMBODIMENTS

The invention will now be described in detail, making reference to the accompanying drawings.

Figure 1:
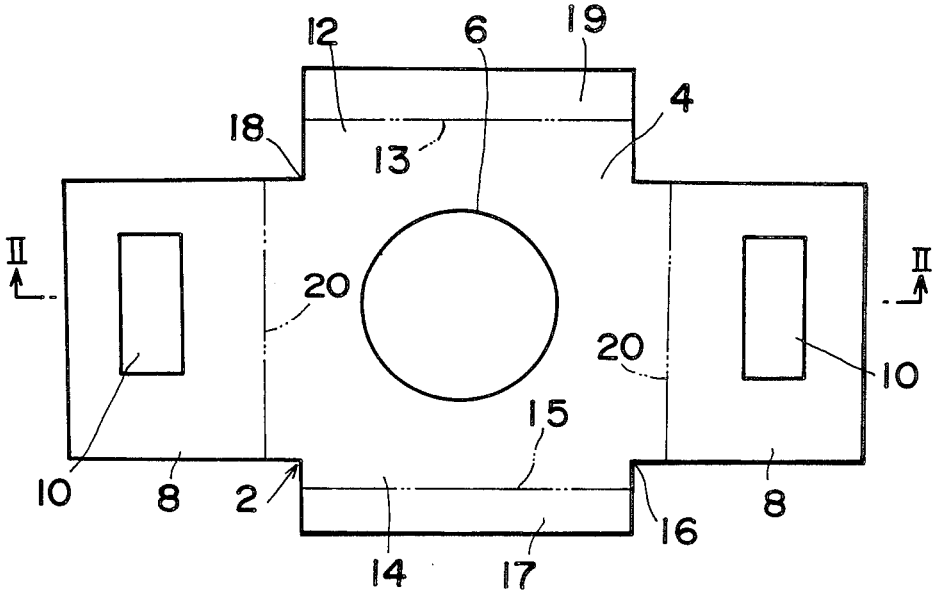
FIG. 1 is a plan view of a blank of a case of this invention which is in an extended state prior to being bent to form the case.

As shown in FIG. 1, a main body 4 of a blank of a case 2 which is in an extended form before being bent to form the case to be fitted to the potentiometer, has a central hole 6 and a pair of long legs 8 provided with holes 10 while extended body portions 12 and 14 are respectively arranged at right angles to the long legs 8 having intersections 16 and 18 therebetween.

The case 2 is preferably comprised of metal or other flexble materials.

Figure 2:
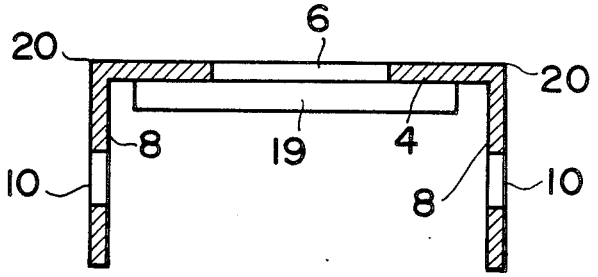
FIG. 2 is a vertical section view taken along line II—II of FIG. 1 after the extended portion thereof is bent to form a case.

In order to obtain a case 2 to be fitted to a housing 24 which will hereinafter be explained in detail, the long legs 8 are bent perpendicularly down along phantom lines 20 extending across the body 4 while extended body portions 12 and 14 are also bent respectively perpendicularly down along phantom lines 13 and 15 so as to fabricate short bent walls 17 and 19 arranged at right angle to the legs 8. The short bent walls 17, 19 cover the housing 24 by extending between the pairs of corner projections 28, 30 respectively. FIG. 2 illustrates a case 2 thus formed by bending, which is taken along line II—II of FIG. 1.

FIG. 3 illustrates a housing 24 on which the case 2 is to be mounted. The housing 24 has a central hole 26 and a chamber 41 in which a rotor 42 which will hereinafter be explained in detail is rotatably held. The housing 24 is preferably of a moulded plastic material and is provided with two pairs of projections 28 and 30 at its four corners while a pair of projection 32 are disposed on both side walls thereof.

Figure 12:
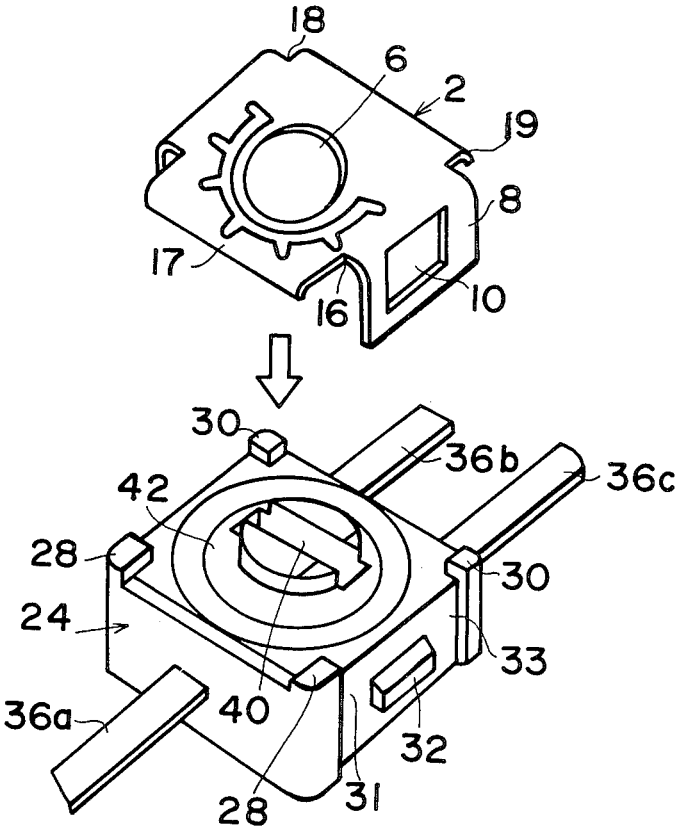
FIG. 12 is a perspective view of a case and a housing including a rotor according to this invention.

Two pairs of vertically extending grooves 31 and 33 are disposed respectively in both sides of the housing 24. These grooves are arranged between the two pairs of wall projections 32 and the corner projections 28 and 30 respectively as shown in FIGS. 3 and 12.

Figure 5:
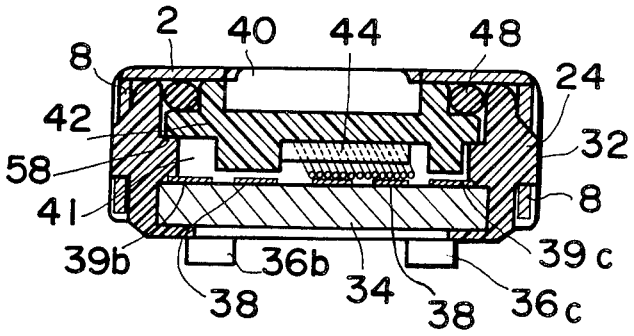
FIG. 5 is a sectional view of FIG. 4 taken along line V—V.

When the case 2 is assembled with the housing 24, the case 2 is pushed down upon the housing 24 with its long legs 8 being slid into the grooves 31 and 33, until the projections 32 disposed on the walls of the housing 24 slidingly snap into the holes 10 of the case 2 whereby the case 2 and the housing 24 are fitted together as a unit (see FIGS. 4 and 5).

Figure 6:
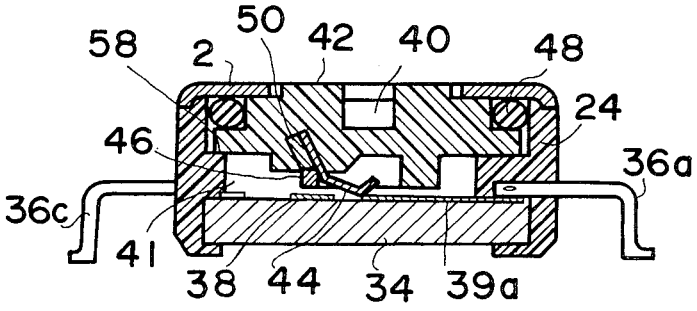
FIG. 6 is a sectional view of FIG. 4 taken along line VI—VI.
Figure 7:
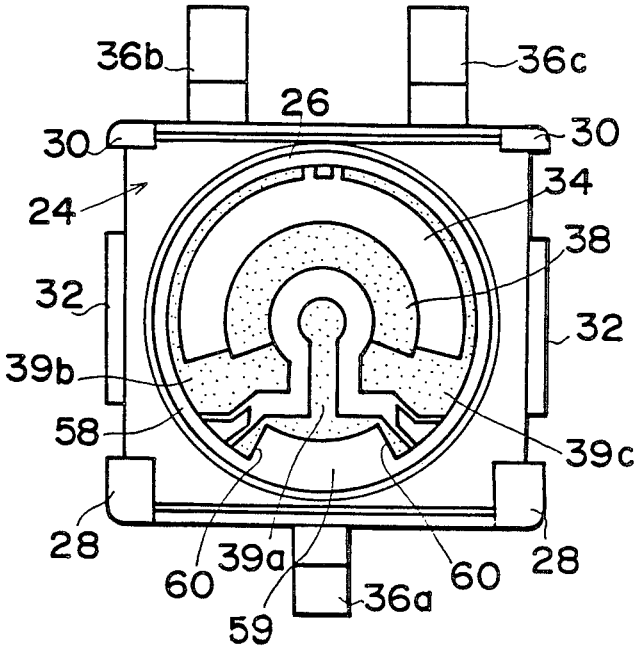
FIG. 7 is a plan view of a base and a housing of the potentiometer of this invention with a rotor removed.
Figure 8:
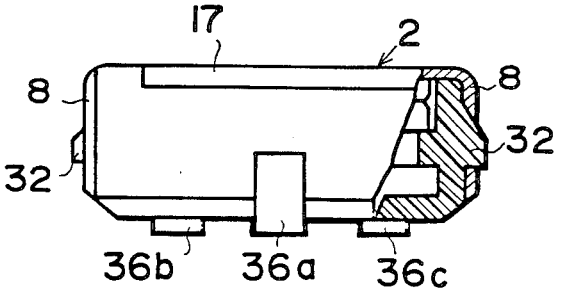
FIG. 8 is a partially broken away side view of a potentiometer of this invention.
Figure 9:
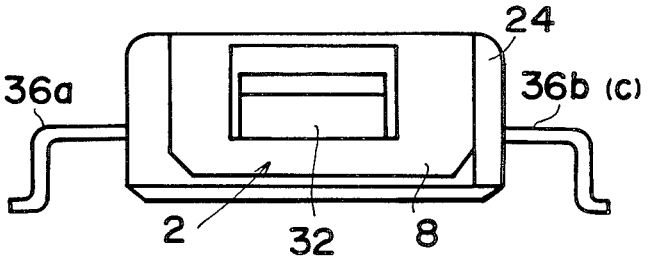
FIG. 9 is another side view of a potentiometer as viewed from a different angle.

However, it should be noted that before assembling the case 2 with the housing 24, a rotor assembly 42 may be received within the chamber 41 of the housing 24 with an O-ring 48 being disposed between the housing 24 and the rotor 42 as shown in FIGS. 5 and 6. Referring now to FIGS. 5, 6, 7, on the surface of a base 34, which is preferably comprised of ceramic materials and which is embedded within the housing 24, there are a resistance element 38 which is which has an arcuate shape and to which conductor elements **39*b* and 39*c* are connected and a collector element 39*a* which is encompassed by the resistance element 38 and conductor elements 39*a* and 39*c***.

Terminal pins **36*b* and 36*c* are connected to the conductor elements 39*b* and 39*c* respectively while a terminal pin 36*a* is connected to the collector element 39*a***.

A rotor assembly 42 rotatably received within a chamber 41 of the housing 24 includes a wiper 44 mounted thereon, as hetertofore described. As is known to these skilled in the art, the wiper element 44 is designed to move relative to the resistance element 38 whereby the resistance of the potentiometer may be varied.

Figure 10:
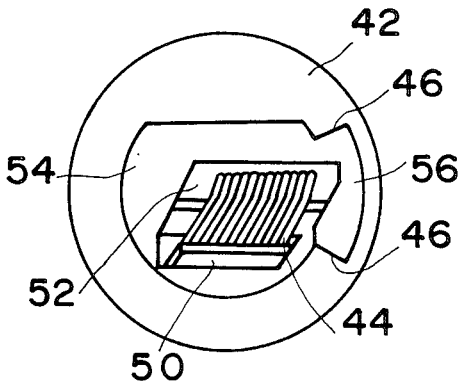
FIG. 10 is a plan view of a rotor in which a wiper is disposed.
Figure 11:
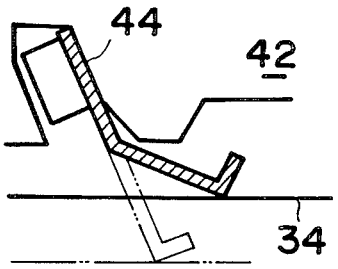
FIG. 11 is a sectional side view of a wiper.

FIG. 10 illustrates an arrangement of a wiper 44 according to this invention. The wiper 44, the end of which is supported by a holder 50 which is integral with the rotor 42, is disposed in a groove 52 encircled on three sides by a raised narrow strip 54. Two end walls of an arcuate section 56 of the raised narrow strip 54 have two vertical walls 46 which together constitute a stopper.

As is shown in FIGS. 6 and 7, a raised narrow circumferential strip 58 is disposed at the inner side of housing hole 26 and adjacent to the collector element **39*a*. A portion of strip 58 has a rectangular shape 59 having two vertical walls 60 which may be adapted as a stoppers. The component parts such as the base 34, the housing 24 and the case 2 are assembled, as shown in FIGS. 5 and 6** to comprise the potentiometer of this invention.

When the rotor 42 is rotated in a clockwise or counterclockwise direction by applying a driver and the like in the slit 40 thereof, the arcuate section 56 having vertical walls 46 rotate with the rotor 42 and the walls 46 abut against alternatively either of the vertical walls 60 disposed adjacent to the collector element **39*a*** are stopped thereat.

The case or the cap according to this invention is simple in structure which permits the assembly of the cap to the housing by means of the projections arranged on the side walls thereof which are snapped into the holes disposed in the legs of the cap or case by a single push down operation.

The structure helps to procure miniaturized potentiometers having a reduced thickness.

The vertical walls of an arcuate portion of a raised narrow strip encircling the wiper and arranged on the rotor, and the vertical walls of the rectangular portion of the circumferencial strip disposed adjacent to the collector element, with which the vertical walls of the wiper are designed to abut alternatively to stop the rotation thereof in accordance with the rotating movement of the rotor, are all arranged within the chamber of the housing thereby facilitating a reduction in the physical size of the potentiometer.

As is evident by the preceding description, the invention may be varied with respect to physical form, and hence it is not limited to the exact details of the above-described presently preferred embodiment, but rather all limitations which fall within the appended claims are seen to embrace the true spirit and scope of the invention.

We claim:

1. A potentiometer in which a rotor is disposed within a chamber thereof, said potentiometer comprising:

a housing having a pair of housing side walls, each of said housing side walls having a side wall projection extending therefrom, a pair of corner projections each of which extends from a respective end thereof, and a pair of grooves each of which extends between said side wall projection and a respective one of said corner projections; and a case having a pair of bent legs each of which has a hole extending therethrough, and a pair of short bent walls covering the top of the housing, said case engaging said housing in a snap-fit manner with the side wall projections of the respective housing side walls extending through the holes and the bent legs of the case extending in the pairs of grooves of the respective housing side walls, whereby said case and said housing may be assembled by one operation in which said case is pressed down over said housing.

2. A potentiometer as claimed in claim 1, wherein each of said short bent walls extend between one of the corner projections of one of said pair of housing side walls and one of the corner projections of the other of said pair of housing side walls.

3. A potentiometer as claimed in claim 1, and further comprising a wiper mounted to the rotor by a holder integral with a surface of the rotor, a narrow ridge extending around three sides of said wiper, and a narrow circumferential strip raised from said housing within the chamber, said narrow ridge having an arcuate portion having two vertically extending ridge walls defining opposite ends thereof, and said narrow circumferential strip having a rectangular-shaped portion having two vertically extending strip walls defining opposite ends thereof, the strip walls for stopping the rotation of the rotor by each engaging a respective one of said ridge walls when the rotor is rotated in either of two rotational directions.

4. A potentiometer in which a rotor is disposed within a chamber thereof, said potentiometer comprising:

a housing having a pair of housing side walls, each of said housing side walls having a side wall projection extending therefrom, and a pair of corner projections each of which extends from a respective end thereof; and a case having a pair of bent legs each of which has a hole extending therethrough, and a pair of short bent walls covering the top of the housing, said case engaging said housing in a snap-fit manner with the side wall projections of the respective housing side walls extending through the holes and the bent legs of the case extending over the respective housing side walls.

* * * * *